US005372452A

United States Patent [19]

Hodgson

[11] Patent Number: 5,372,452

[45] Date of Patent: Dec. 13, 1994

[54] POWER TROWELS

[76] Inventor: James A. Hodgson, BearConeq, 736 NW. 40th St., Fargo, N. Dak. 58102

[21] Appl. No.: 22,057

[22] Filed: Feb. 24, 1993

[51] Int. Cl.[5] ..... E01C 19/22

[52] U.S. Cl. ..... 404/112; 404/97

[58] Field of Search ..... 404/83, 84.05, 84.1, 404/84.5, 96, 97, 101, 102, 118, 120, 112

[56] References Cited

U.S. PATENT DOCUMENTS

| | | | |
|---|---|---|---|
| 2,667,824 | 2/1954 | McRery | 404/112 |
| 2,888,863 | 6/1959 | Eisenbeis | 404/112 |
| 3,402,647 | 9/1968 | Colizza et al. | 404/112 |
| 3,791,754 | 2/1974 | Zochil | 404/112 |
| 3,936,212 | 2/1976 | Holz, Sr. et al. | 404/112 |
| 4,027,991 | 6/1977 | Maass | 404/112 |
| 4,046,483 | 9/1977 | Sutherland | 404/112 |
| 4,198,178 | 4/1980 | Carlstrom et al. | 404/112 |
| 4,232,980 | 11/1980 | Tertinek et al. | 404/112 |
| 4,556,339 | 12/1985 | Morrison | 404/112 |
| 4,889,675 | 12/1989 | Chiuminatta etal. | 264/154 |
| 4,938,201 | 7/1990 | Chiuminatta et al. | 125/13.01 |
| 5,056,379 | 10/1991 | den Ouden | 74/858 |
| 5,102,258 | 4/1992 | Berger | 404/97 |

OTHER PUBLICATIONS

Forshel, "The Bantam, 20" Hand Held Power Trowel.

Structron, "Superhandle II, The Next Generation of Fiberglass Extension Handles".

*Primary Examiner*—Ramon S. Britts

*Assistant Examiner*—James A. Lisehora

*Attorney, Agent, or Firm*—Westman, Champlin & Kelly

[57] ABSTRACT

An improvement to power trowels having a power unit, a rotatable shaft, a plurality of trowling blades mounted to spider arms, and a shroud for shielding the blades. The blades are formed of spring steel and are fixedly mounted to the spider arms. A throttle control unit is removably mounted to the trowel and may be extendably mounted to an adjustable extendible pole.

24 Claims, 7 Drawing Sheets

40
42
43
44
46
47
48
50
51
53
55
57
58
59
65
66
67

POWER TROWELS

BACKGROUND OF THE INVENTION

The present invention relates to an improvement to power trowling machines and, more particularly, relates to making the trowling machine lightweight and with fixed pitch spring steel blades, therefore making the machine very easy to use.

Trowling machines for finishing concrete or other surfaces have been known for many years. Common to these trowling machines are a centrally mounted power unit, such as an internal combustion engine, attached to a handle for holding and maneuvering the machine, a gear reducing unit connected to the power unit and a trowling assembly which rotates about a vertical axis beneath the power unit. The rotatable trowling assembly commonly comprises a hub mounted on a vertical shaft which is rotatable by the power unit through the gear reducing unit, and a plurality of trowling blade carriers in the form of arms extending radially from the hub. Typically, each carrier adjustably supports a trowling blade which extend radially and are usually inclined at a small pitch angle from the horizontal plane, with their trailing edges lowermost. The blades are effective to finish smoothly a surface of wet concrete or the like.

Exemplary of early trowling machines are U.S. Pat. No. 4,629,359 to Sengupta and U.S. Pat. No. 4,198,178 to Carlstrom et al. Both the Sengupta and the Carlstrom et al. patent disclose power trowels having adjustable pitched blades. U.S. Pat. No. 4,046,483 to Sutherland discloses a power trowel having an adjustable blade length and an adjustable blade pitch.

Traditionally, finishing concrete was a time consuming and delicate job. To create a desirable finish to the concrete, surface pores on the concrete must be closed by means of a trowling action either by hand or a trowling machine. The surface pores must be closed without disturbing larger aggregates that lie just below the surface that form a wearing plate. If this wearing plate is disturbed, the concrete will be subject to premature deterioration.

The previously mentioned known power trowels are typically of such a substantial weight that to place them on a wet concrete surface shortly after it has been poured will destroy the wearing plate and cause premature deterioration of the concrete. The operator must wait until the concrete substantially sets. Waiting for the concrete to substantially set up extends the finishing time, which in turn correlates to high labor costs wasted while waiting for the concrete to set. Also because of the size of the previously known power trowling machines, a substantial amount of operator strength is required to operate one of these machines. Furthermore, a great deal of experience and skill is needed to effectively operate them because the trowling blades of these known power trowling machines need to be adjusted in order to achieve a proper finish to the concrete. Each adjustment of the trowling blades has an effect on the finish of the concrete. Too steep of a pitch will dig too deeply into the wearing plate, thus causing premature deterioration of the concrete. Not enough pitch may not close the surface pores, thus creating a rough and incompletely finished surface.

SUMMARY OF THE INVENTION

The present invention provides a light weight power trowling machine that has fixed pitch spring steel blades thus making the machine very easy to operate. In a preferred embodiment of the present invention, a power trowling machine having the same basic elements as previously known power trowels is improved by fixedly mounting trowling blades onto mounting means. The trowling blades are not adjustable and are made of spring steel instead of the standard high tensile steel. A removable throttle control means is provided to control the speed and operation of the trowling machine. A plurality of throttle control connections are located on the power unit to accommodate left and right handed operators and to allow the operator a choice of where to mount the throttle control. The throttle control means may be mounted directly to one of the throttle control connections or can be mounted to the end of an extendible pole which in turn is connected to one of the throttle control connections. Thus, an operator may operate the improved power trowel from extended distances, such as 10 or 20 feet away from the concrete surface being finished. A power control means is mounted on the power unit and is electrically actuated by the throttle control.

A plastic shroud is provided to shield the blades during their operation. The shroud is comprised of a lower retaining ring and an upper guard portion. In order to allow the improved power trowel to finish near walls or edges, the lower retaining ring portion has four flat sections spaced evenly about the periphery of the lower retaining ring. The four flat sections allow the trowling blades to come within one quarter inch from the edge of the lower retaining ring.

Figure 7:
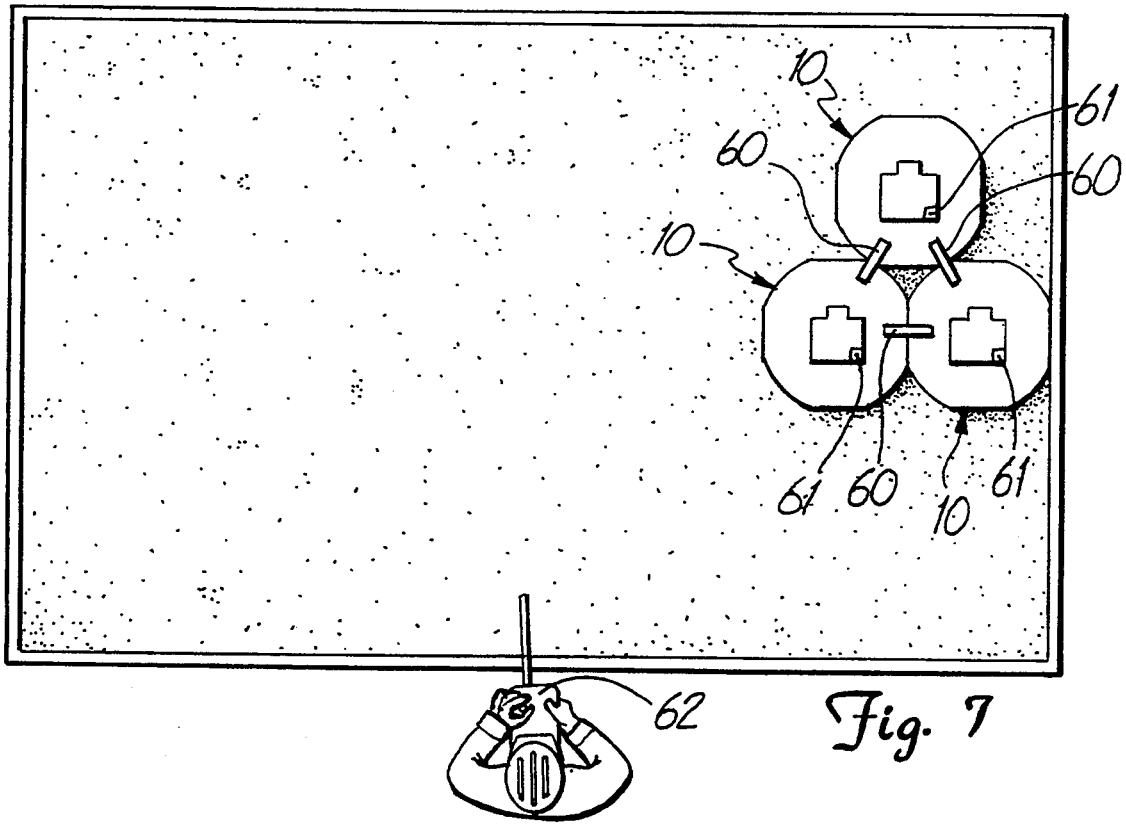
Figure 8:
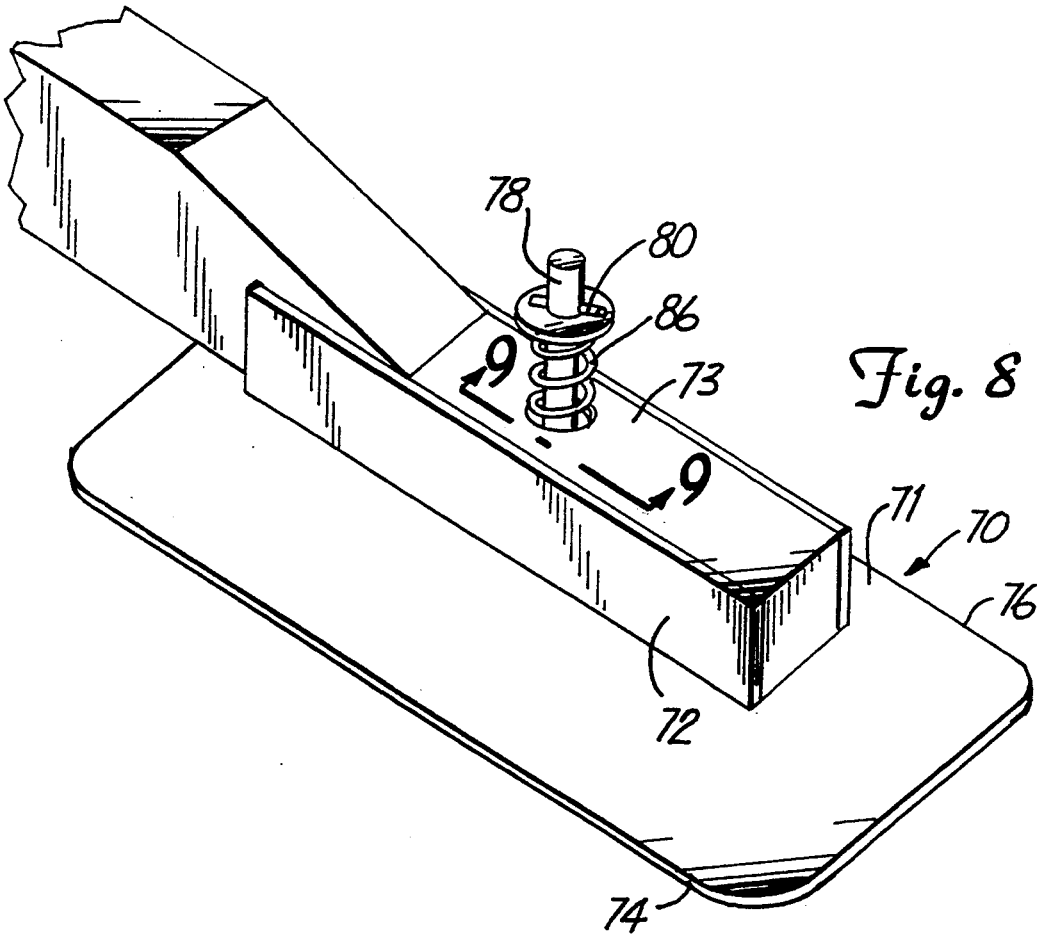

FIG. **6*b*** is a top plan view of a portion of the throttle control;

FIG. **6*c*** is a sectional view of a portion of throttle control mounting to an extendible pole;

FIG. 7 is a schematic plan view of a preferred alternative embodiment;

FIG. 8 is a perspective view of an preferred alternative embodiment; and

Figure 9:
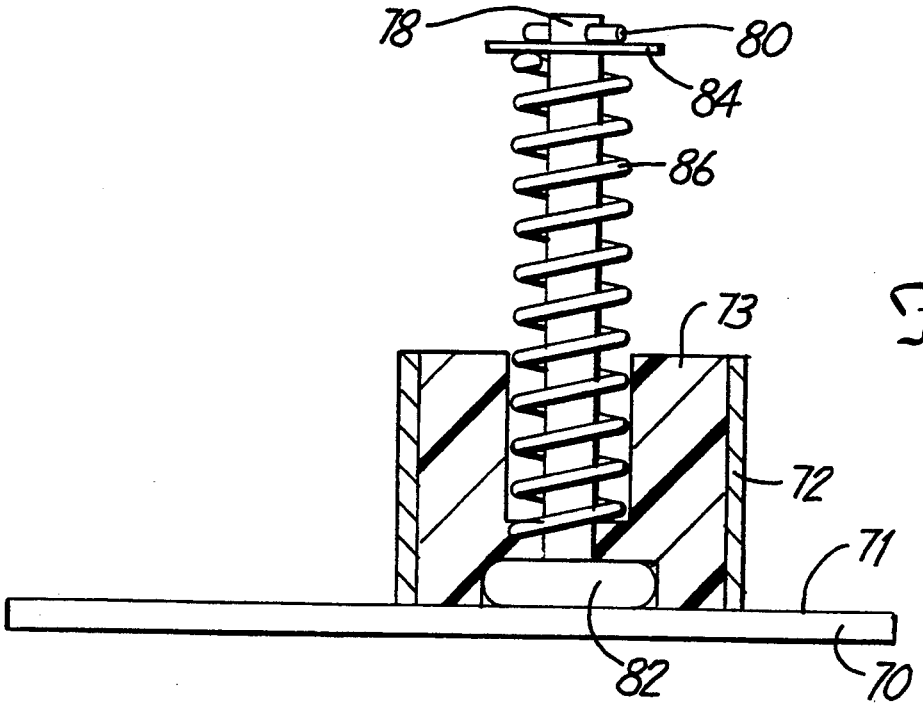

FIG. 9 is a sectional view taken along line 9—9 of FIG. 8.

DETAILED DESCRIPTION OF THE PREFERRED EMBODIMENTS

Figure 1:
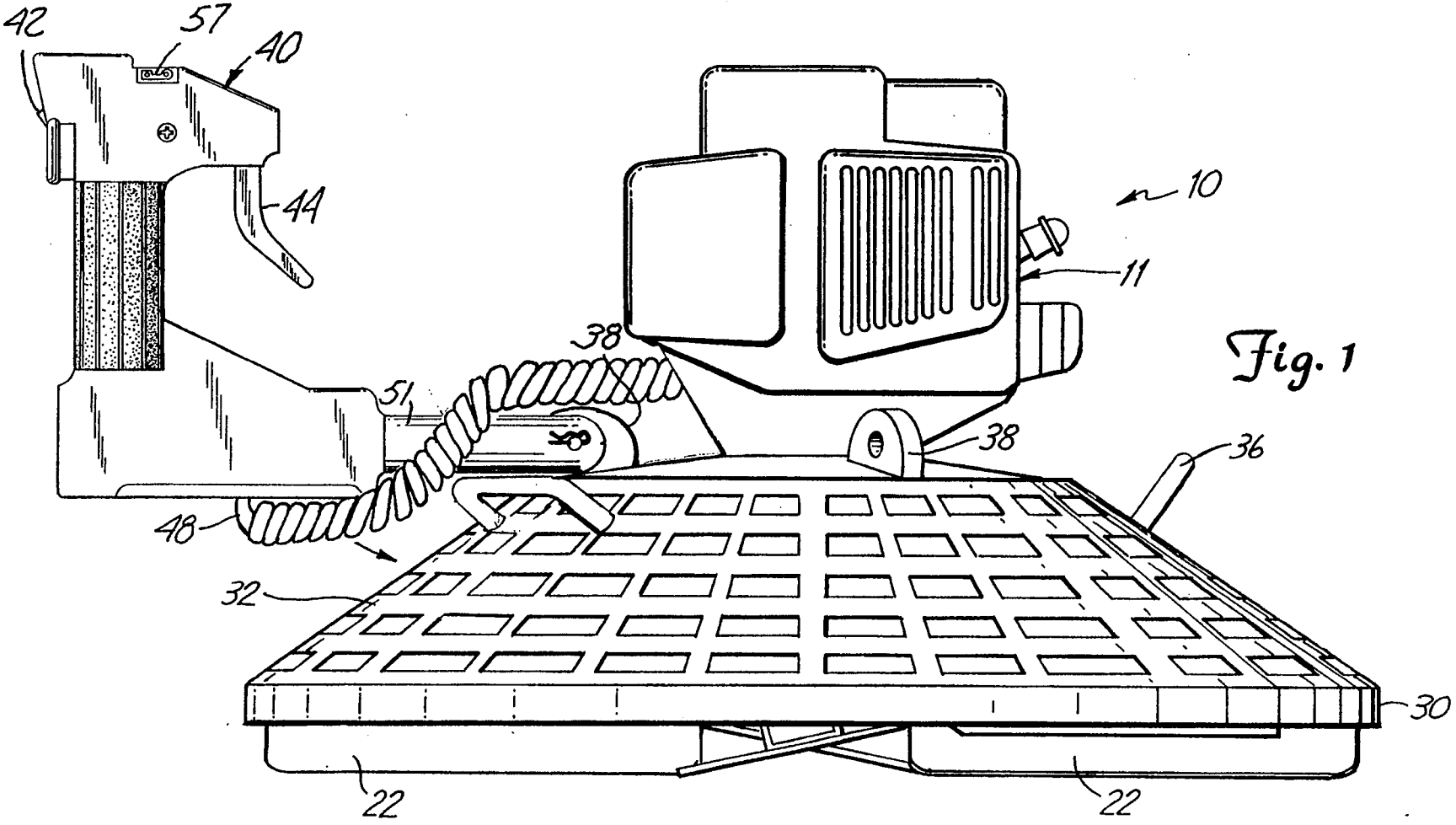
FIG. 1 is a side elevational view of a power trowel made according to the present invention.

The present invention comprises a lightweight, easy to use power trowel shown generally at 10 in FIG. 1. A power unit shown generally at 11 powers the trowling machine 10. The power unit 11 utilized in the embodiment illustrated is a two stroke engine, but it should be noted that any power unit developing sufficient power to rotate trowling blades on wet concrete may be used, such as an electric motor or a four stroke engine.

Figure 2:
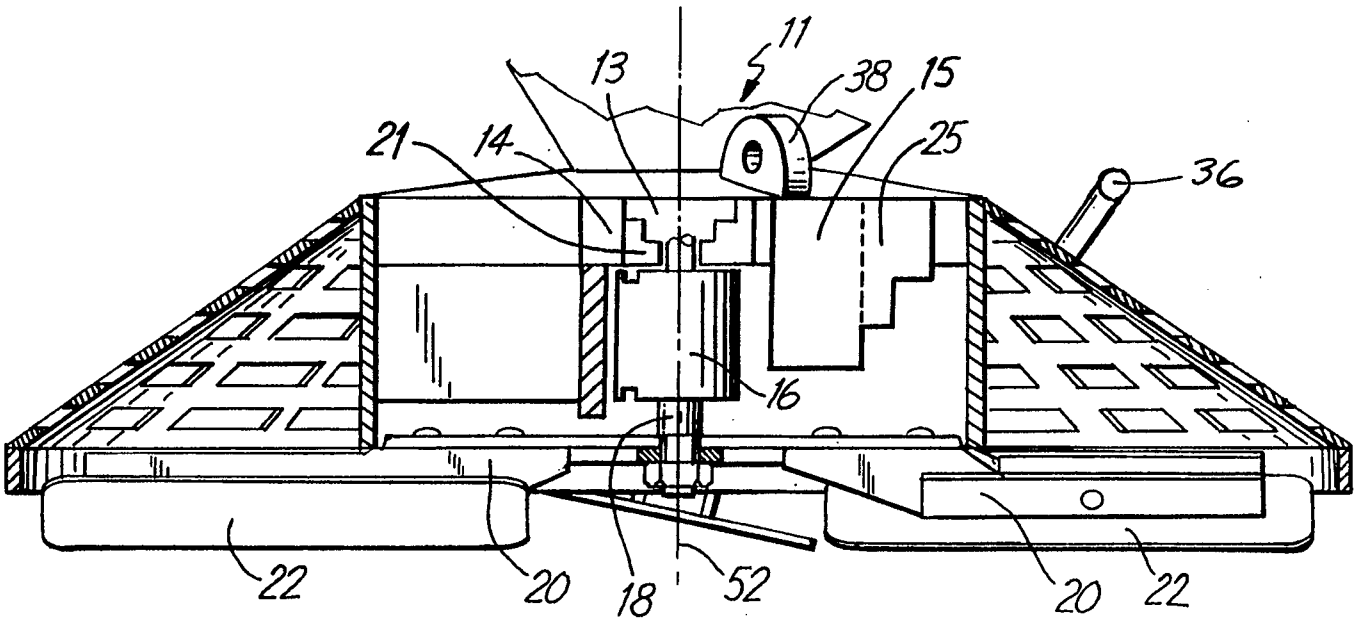
FIG. 2 is a schematic view of the drive assembly of the power trowel.

As illustrated schematically in FIG. 2, a servo motor 14 is mounted to the power unit 11. A throttle 21 is connected to the servo motor 14 to control the power unit 11 as will be described later. An electric starter 15 is mounted to the power unit 11 to provide the power trowel 10 with a simple way of starting. A battery pack 25 comprising rechargeable batteries is part of the electric starter 15. The batteries 25 are charged when the power trowel 10 is in use or they can be charged externally as will be described below. A clutch assembly 13 is positioned below the power unit 11 and operates in a commonly known manner. A gear reducing means 16 is positioned below the clutch assembly 13, and in the preferred embodiments has an 80 to 1 gear reduction. For the present invention, any type of gear reduction less than 100 to 1 would be acceptable.

Figure 3:
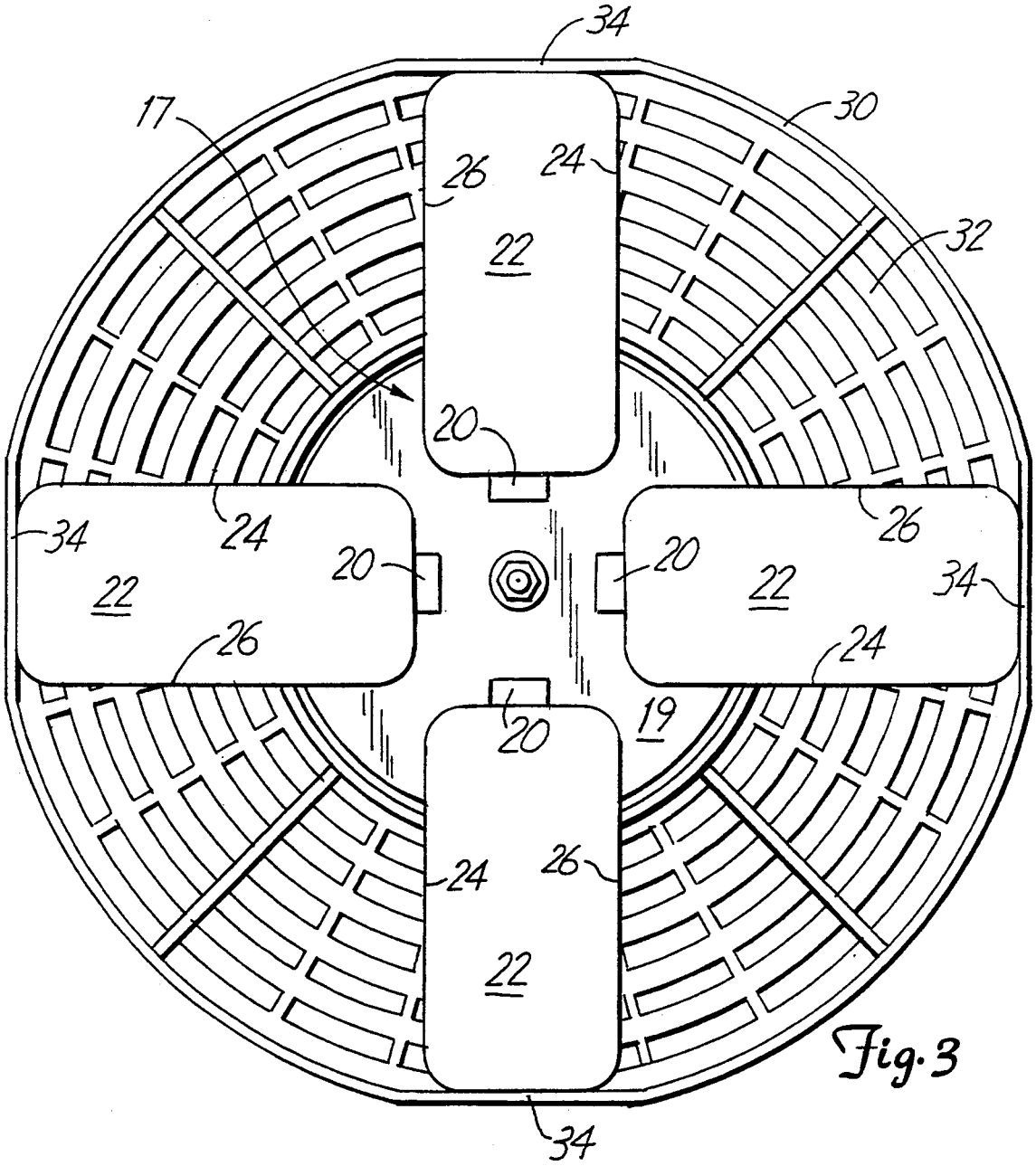
FIG. 3 is a bottom plan view of the power trowel.

A rotatable drive shaft 18 extends below the gear reducer 16 and provides a rotating means for the trowling unit 10. A rotating assembly 17, as seen in FIG. 3, is attached to the rotatable drive shaft 18. The rotating assembly 17 comprises a hub 19 and a plurality of arms 20, generally called spider arms, connected to the hub 19. Any number of spider arms 20 may be used, but in the embodiment illustrated there are four spider arms 20.

Figure 4:
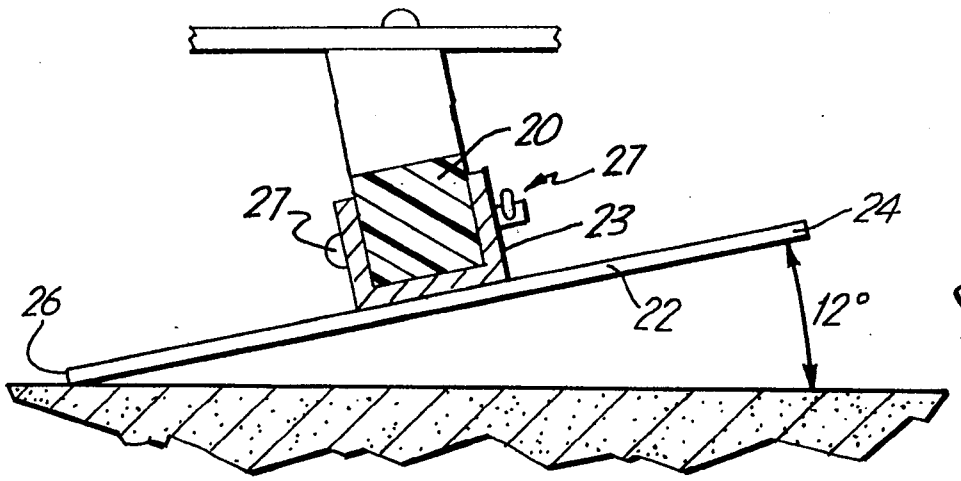
FIG. 4 is an end view of the trowling blades showing the angle of pitch.

A trowling blade 22 is connected to each of the spider arms 20. The trowling blades 22 of the present invention are formed from thin spring steel which permits the blades 22 to flex with respect to their supports. Each of the blades 22 is fixedly mounted to the spider arms 20 by common fastening means such as a hitch pin assembly 27 as shown in FIG. 4. Each trowling blade 22 has a channel 23 attached to its upper or back side. This channel 23 fits around the spider arm 20 and has holes to receive the hitch pin assembly 27, which fastens the blade 22 to the spider arm 20. The channel 23 in the preferred embodiment is retained along the longitudinal axis of each blade 22.

As the blades 22 rotate, each blade has a leading edge 24 and a trailing edge 26. The blades 22 are fixedly mounted to the spider arm 20 so that the leading edges 24 are raised and the plane of the blades 22 are 12 degrees from horizontal, as is illustrated in FIG. 4. Thus, when rotating, the trailing edges 26 of blades 22 will contact the concrete surface while the leading edges 24 remain off the concrete surface.

A plastic shroud 28 is attached to the power unit 11 and extends downwardly and outwardly, encircling the path traveled by the blades 22. Plastic is used because it is light weight, easier to mold into different shapes or forms for the shroud 28, and it is resistant to the corrosive additives normally found in concrete. Plastic is also used because of the integral coloring available which enhances the appearance of the machine as opposed to painted metal which has a tendency to chip. It should be noted that the spider arms 20 may also be made of plastic and the casing of the power unit 11 may be made of plastic, but use of other materials for both of these components is acceptable. The shroud 28 has two portions; a lower retaining ring 30 at the periphery of the blade travel path, and an upper guard portion 32 that surrounds the rotating assembly 17 and tapers from the lower retaining ring 30 up to the power unit 11. The upper guard portion 32 may be formed from a solid plastic mold or it may have viewing holes as illustrated in the Figures so that the operator may see the rotation of the blades 22.

The lower retaining ring 30 is formed to have four substantially flat portions 34 spaced equally around the outer periphery of the lower retaining ring 30 as illustrated in FIG. 3. These flat portions 34 allow an operator to get within one-quarter inch of the edge of the retaining ring and thus close enough to a form or wall so as to virtually eliminate the need for hand trowling. In previously known power trowels, the closest an operator could get was often two or three, and sometimes four inches from a wall, thus requiring substantial hand trowling to finish the job properly. A number of D handles 36 are spaced evenly across the guard portion 32 of the shroud 28 for an operator to hold while using the power trowel 10 in a non-extended manner. There are three handles 36 spaced about the shroud 28 in the preferred embodiment. Mounting members or ears 38 are fixed to the shroud 28. Two ears 38 are shown in FIG. 1, but preferably there are three such ears spaced 120 degrees apart on the shroud. A mower unit throttle control 40 attaches to one of the mounting ears 38 and has controls coupled by a coiled cord 48 to the power unit controls to control the speed of the power trowel 10. An extendible pole 50, to be described in more detail below, may be mounted to one of the mounting ears 38 in place of the throttle control 40 with the throttle control 40 then being attached to the other end of the extendible pole 50. This allows for operation of the power trowel 10 from an extended distance.

Figures 6, 6B, 6C:
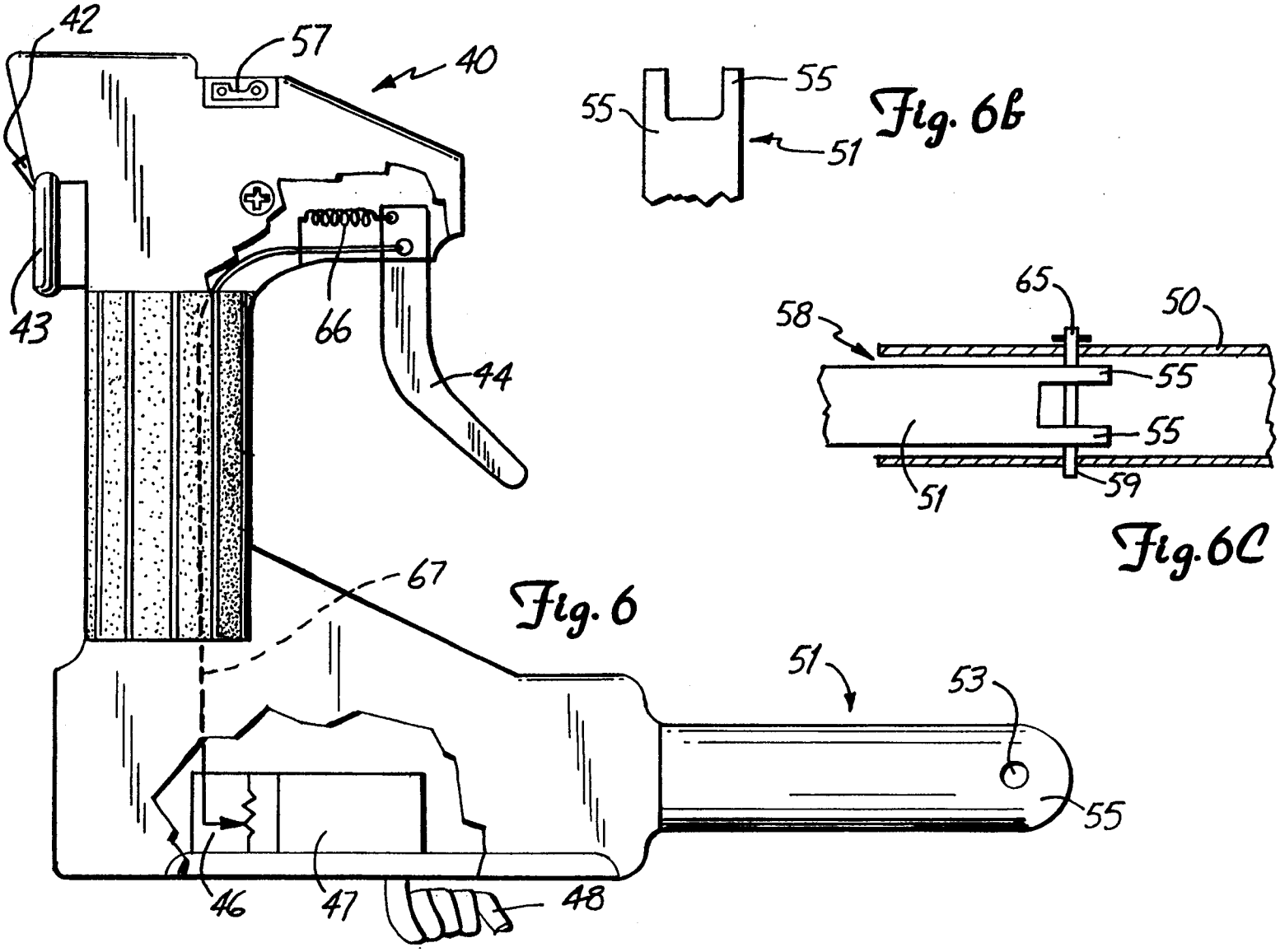
FIG. 6 is an enlarged perspective view of a throttle control.

An on/off switch 42, to turn the machine on, and a start button 43 to activate the electric starter 15 are mounted on the throttle control 40 as is illustrated in FIG. 6. The on/off switch 42 acts as a kill switch. If the switch 42 is on and the trowling machine 10 is running, when the switch 42 is turned to off, the machine will be stopped. A spring loaded trigger control 44 is provided on the throttle control 40 to control the speed of the power unit 11 and thus the speed of rotation of the trowling blades 22. A spring 66 is provided to return the trigger control 44 to its home position when it is released. The trigger control 44 is a variable speed controller in which the blades 22 rotate at speeds dependant upon the amount that the trigger is pulled.

A potentiometer 46, which is shown schematically in FIG. 6, is mounted in the throttle control 40 and enables the servo motor 14 to control the throttle 21 of the power unit 11 electrically rather than by a mechanical connection. A cable 67 directly couples the potentiometer 46 to the spring loaded trigger 44. When the trigger 44 is pulled, the cable 67 moves the potentiometer 46 thus changing the effective resistance of the potentiometer 46. A servo driver 47 is mounted adjacent the potentiometer 46 in the throttle control 40 to drive the servo motor 14.

The coiled cord 48 electrically couples the throttle control 40 to the power unit 11 to enable the trigger control 44, potentiometer 46 and servo driver 47 to electrically control the servo motor 14, and to couple the on/off switch 42 and the start button 43 to the electric starter 15. The throttle control 40 has a yoke attachment 51 for attaching directly to the mounting ears 38. The yoke attachment comprises a pair of spaced mounting tabs 55 similar in size to the mounting ears 38 as illustrated in FIG. **6*b*. The tabs 55 are spaced apart enough to fit around the mounting ears 38. Pin holes 53 to secure the throttle control 40 to the mounting ears 38 are provided in the tabs 55. The yoke attachment 51 is of a size to fit into the extendible pole 50**, to be described.

A charging receptacle 57 is also provided on the throttle control 40. The charging receptacle is for charging the battery pack 25, or if an electric motor is chosen as the power unit, for charging the batteries associated with the electric motor.

Figure 5:
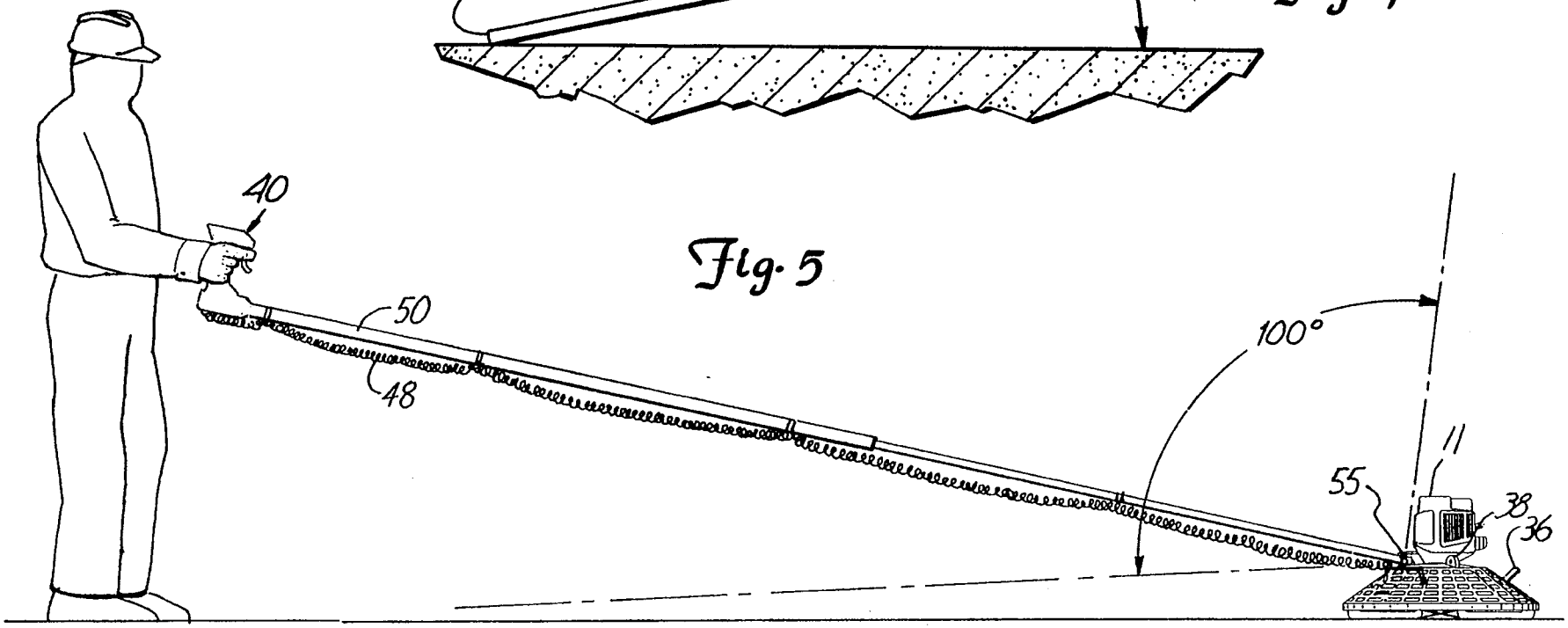
FIG. 5 is a side elevation view of the power trowel utilizing an extended pole.

The throttle control extendible pole 50 may be used to control the power trowel from extended distances such as 10 or 20 feet. The distance the pole is extended to is dependant upon the integrity of the pole. The stronger the pole is the farther it can be extended. The extendible pole 50 connects to one of the mounting ears 38 at one end and receives the throttle control 40 yoke attachment 51 at the other end. As illustrated in FIG. 6*c*, the yoke attachment 51 is inserted into aperture 58 of the extendible pole 50. Retaining pin holes 59 are provided in the walls of the extendible pole 50 as shown. The yoke attachment 51 is inserted approximately three inches into aperture 58 where pin holes 53 of the tabs 55 align with pin holes 59 of the extendible pole 50. When the pin holes align, a cotter pin or other retaining pin 65 is inserted. The extendible pole 50 used in the embodiment illustrated in FIG. 5 is the Superhandle II by Structon, but any such extendible pole may be used.

The coiled cord 48 stretches to extend along the extendible pole 50 and is retained by commonly known retaining means so as to not drag down into the concrete. The extendible pole 50 has a range of motion that encompasses approximately 100 degrees of movement in a vertical plane wherein the upper rotation is limited when the extendible pole 50 strikes the power unit 11 and the lower limit is set when the extendible pole 50 strikes the concrete surface.

In operation, once a concrete surface that is in need of finishing has begun to set, the present invention may be utilized. The power trowel 10 made according to the present invention will be able to begin finishing the concrete well in advance of the time that conventional power trowels and operator would be able to get out onto the concrete surface. Often times, the present invention may be used sooner than traditional kneeboards and hand trowling because with the extendible pole 50 an operator does not need to step or kneel on the concrete surface at all. Before starting use, the operator must decide if the throttle control 40 should be mounted directly to the power trowel 10 or if the extendible pole 50 is going to be used. Once the throttle control 40 is mounted to either the power trowel 10 or the extendible pole 50, the on/off switch 42 on the throttle control 40 may be switched, turning the machine on.

With the on/off switch 42 set to on, the machine may be started by depressing the start button 43. With the machine now on, pulling of the trigger control 44 causes the blades 22 to rotate. This function is achieved electrically through the potentiometer 46, the servo driver 47 and the servo motor 14. As the trigger control 44 is pulled, the potentiometer 46 is moved by the cable 67, thus changing the effective resistance of the potentiometer 46. By changing the resistance of the potentiometer, the current sent to the servo motor 14 by the servo driver 47 is changed. Increasing the resistance of the potentiometer reduces the current sent to the servo motor 14, and reducing the resistance of the potentiometer increases the current sent to the servo motor 14. Current to the servo motor 14 is provided from the servo driver 47 through the coiled cord 48. The servo motor 14 in turn drives the throttle 21 of the power unit 11 to a set position proportional to the current received by the servo motor 14. This electrical arrangement is used in place of a traditional mechanical throttle control, where a cable is run from the throttle trigger to the carburetor of the power unit, because the reliability of the electrical control system is far greater than the mechanical system when used at extended distances. It should be noted that other connecting methods may be used, such as an air piston drive system or other commonly known extendible control systems.

With the blades 22 rotating, the trailing edge 26 of the blade 22 is contacting the concrete surface and supporting the power trowel 10. With the power trowel 10 on and the blades 22 rotating, the power trowel will virtually hover in place. This is due in part to the fact that the power trowel of the present invention is lightweight and does not provide a great deal of torque. It is also due to the fact that the center of gravity of the power trowel 10 is directly above the axis of rotation of the trowling blades 22, shown at 52 in FIG. 2. The gear reduction means 16 lies on the axis of rotation 52 of the blades as does the drive shaft 18, the clutch assembly 13, and the power unit 11. Because the power trowel 10 does not pull hard in any direction, the power trowel of the present invention is very easy to manipulate.

As previously stated, with the trowling blades 22 rotating, the trailing edge 26 of each blade is contacting the concrete surface. Because spring steel trowling blades are used, adjustment of the blade pitch is not necessary. The spring steel blades deflect to form a proper finished surface. In the embodiment illustrated, each blade is 4 inches wide and 0.0025 inches thick. With this blade size, the weight displacement ratio for the power trowel 10 is 1.25 oz/in$^2$ of blade area. To get out onto the concrete surface even earlier, the weight displacement ratio can be reduced. This can be accomplished by using a blade 6 inches wide and 0.0015 inches thick. This reduces the weight displacement ratio to 1.125 oz/in$^2$.

In a preferred alternative embodiment, illustrated in FIG. 7, three power trowels of the type described are connected together in a triangular configuration. Each of these power trowels is similar to the power trowel 10 described with reference to FIGS. 1–6*b*. Corresponding numbers will be used to identify corresponding parts. Connecting bars 60 connect the three trowling machines 10 in triangular form. A servo motor 14 is mounted to each of the power trowels 10. A radio frequency receiver 61 is attached to the power trowels 10 and is coupled to the servo motors 14. Instead of directly coupling the servo motor to the throttle control means 40, the servo motors 14 are remotely operated. A radio frequency transmitter 62, of the type commonly known in radio control modeling, may be used to operate the power trowels 10. This configuration would allow an operator to finish larger surface areas from distances greater than possible with the extendible pole 50.

In another preferred alternative embodiment, a way to vary the trowling force applied to the concrete by the trowling blades is provided. The blades of this preferred alternative embodiment are illustrated in FIGS. 8 and 9. This embodiment provides trowling blades 70 having channels 72 attached to an upper or back side 71 of each blade 70. The channels 72 fit around spider arms 73 that rotate the blades 70. The channels 72 of the alternative embodiment may be formed anywhere along the upper or back sides 71 of the blades 70.

In FIG. 8, the blades 70 have an edge 74 touching the concrete surface and incline up and away from the concrete to an edge 76. In the illustrated preferred alternative embodiment, the channel 72 is placed closer to the edge 76 than the lower, trailing edge 74. In this position, the blade 70 will flex more than if the channel were midway on the blade 70, thus allowing an operator to begin finishing the concrete sooner than if the channel were in the middle of the blade 70.

To increase the amount of trowling force applied to the concrete by the blades 70, the channel 72 should be placed nearer to the edge 74. By rotating the blades 72 180 degrees, or end for end, the same blades may be used to finish concrete that has set up longer and thus requires a more rigid blade for satisfactory trowling.

The mounting arrangement of this preferred alternative embodiment allows the blades 70 to be rotated end for end. A substantially vertical pin 78 having a cotter pin 80, a head 82, a washer 84 mounted on the pin 78 and a compression spring 86 slidably mounted on the pin 78. The base of the blade 70 is bored out to receive the head 82 of the pin 78 which is fused to the blade 70. The cotter pin 80 is provided to retain the washer 84 on the pin 78 which in turn retains the compression spring 86 on the pin 78.

To rotate the blade 70 end for end, the blade 70 is pushed downward away from the spider arm 73 until 10 the channel 72 is clear of the spider arm 73. When the channel 72 is clear of the spider arm 73 the blade 70 may be rotated. When the blade has been rotated 180 degrees, the channel will again fit around the spider arm. The compression spring 86 tends to pull the blade 70 toward the spider arm 73 thereby keeping the blade in close proximity to the spider arm 73.

This preferred alternative embodiment makes it easy to change the amount of trowling force applied to a concrete surface. The pin arrangement illustrated also makes it easy to replace blades. To replace the blades 70, the cotter pin 80 is removed, the washer 84 is then removed from the pin 78 and the spring 86 is then slide off of the pin 78. The blade 70 is then replaced by a new blade.

Although the present invention has been described with reference to preferred embodiments, workers skilled in the art will recognize that changes may be made in form and detail without departing from the spirit and scope of the invention.

What is claimed is:

1. An improvement to trowling machines having a power unit, a rotatable shaft extending downward therefrom, a plurality of trowling blades, mounting means for mounting the trowling blades to the rotatable shaft, and a shroud for shielding the blades, the improvement comprising:

the blades being mounted to the mounting means at a selected pitch;

an attachment member fixed to the exterior of the shroud;

a manually operated throttle control including a manual grip and control element and having a short length pole, mounting means on the short pole for removably mounting the short pole to the attachment member on the shroud to control the power unit and to permit guiding the shroud from adjacent the shroud;

a power unit control coupled to the control element to control the power unit; and an elongated pole having first and second ends and means for mounting a first end of the elongated pole to the mounting member on the shroud when the short pole is removed, and means for receiving the short pole at the second end of the elongated pole, wherein the throttle control is extendably mounted by the elongated pole.

2. The trowling machine of claim 1 wherein the blades are formed of spring steel.

3. The trowling machine of claim 1 wherein the blades are planar and are mounted to the mounting means with the blade plane at a pitch angle of 12 degrees.

4. The trowling machine of claim 1 wherein the elongated pole is pivotally mounted and is pivotal up to 100 degrees in motion.

5. The trowling machine of claim 1 wherein the power unit control is electrically actuated by the throttle control means.

6. The trowling machine of claim 5 further including a coupling to electrically couple the throttle control to the power unit control means.

7. The trowling machine of claim 1 wherein the shroud is made of plastic.

8. The trowling machine of claim 1 wherein the mounting means comprise arms extending radially from the shaft, the blades each having a support positioned laterally of a longitudinal center line of the blade and the support being mountable to the mounting means, such that each of the blades can be turned end for end on its respective support to provide a different width of blade rotationally trailing the mounting means.

9. An improvement to trowling machines having a power unit, a rotatable shaft extending downward therefrom, a plurality of trowling blades having first and second ends, mounting means for mounting the trowling blades to the rotatable shaft, and a shroud for shielding the blades, the improvement comprising:

the blades each being mounted to the mounting means selectively in a first position with a first end of the respective blade adjacent an outer periphery of the shroud and in a second position with a second end of the respective blade adjacent the outer periphery of the shroud, wherein the blades are formed of spring steel and are fixed at a pitch angle between the range of 5 degrees and 20 degrees from horizontal during operation;

at least one throttle control connection being located on the power unit;

throttle control means removably mounted to one of the throttle control connections;

power unit control means mounted to the power unit to control the power unit to rotate the mounting means and blades, each blade having a different length rotationally trailing the mounting means in its respective first and second positions.

10. The trowling machine of claim 9 wherein the blades are planar and are mounted to the mounting means with the blade plane at a pitch angle of 12 degrees.

11. The trowling machine of claim 9, wherein the throttle control means is extendably mounted to be shrewd by a replaceable, extendible pole.

12. The trowling machine of claim 11, wherein one end of the extendible pole is pivotally mounted to the shroud and pivots up to 100 degrees in motion.

13. The trowling machine of claim 9 wherein the power unit control means is a servo motor mounted to the power unit.

14. The trowling machine of claim 9 wherein the power unit control means is remotely actuated.

15. The trowling machine of claim 9 wherein the power unit control means is electrically actuated by the throttle control means.

16. The trowling machine of claim 15 further including a coupling means to electrically couple the throttle control means to the power unit control means.

17. The trowling machine of claim 9 wherein the shroud comprises a lower retaining ring and an upper guard portion, the lower retaining ring having four substantially flat sections spaced equally around the periphery of the ring.

18. The trowling machine of claim 9 wherein the shroud is made of plastic.

19. The trowling machine of claim 9 wherein each of the blades is pivotally mounted to its mounting means about a generally upright bolt, each of the blades having a channel means that fits around the mounting means and which can be pivoted about the bolt 180° between the first and second positions for operation.

20. An improvement to trowling machines having an internal combustion power unit, a rotatable drive shaft extending downward therefrom, a plurality of trowling blades, mounting means for mounting the trowling blades to the rotatable shaft, and a shroud for shielding the blades, the improvement comprising:

the blades being mounted to the mounting means, the blades being formed of flexible spring steel and being mounted at a pitch of angle between 5 and 20 degrees from horizontal as they move;

a plurality of control connections located on the power unit including a throttle control connection to control speed of operation;

a throttle control removably mounted to the throttle control connection;

a power unit control removably mounted to the power unit to control the power unit, the power unit control being electrically actuated; and the shroud comprising a lower substantially vertical skirt forming a retaining ring and upper guard wall portion tapering upwardly from the skirt and extending around the entire ring to overlie and enclose regions above the blades with the guard wall, the power unit being mounted at an upper end of the upper guard wall, 21. The trowling machine of claim 20 wherein the lower vertical skirt is a peripheral skirt and has four substantially flat sections spaced equally around a periphery of the skirt, the blades passing closely adjacent to an inner surface of the skirt at the flat sections to permit trowling close to a vertical surface at the flat sections of the skirt.

22. The trowling machine of claim 20 wherein the shroud is made of plastic.

23. The trowling machine of claim 20 wherein the mounting means comprise generally radial arms, the blades having a length extending radially and a lateral width, a separate support fastened to each blade and positioned on the blade offset from the longitudinal axis, the support being mountable on the mounting means in two positions 180° apart to provide a different width of the blade to trail the arm in each of the two positions to provide a different width of blade trailing the mounting means in each of the two positions.

24. An improvement to trowling machines having a power unit, rotatable shaft extending downward therefrom, a plurality of trowling blades, mounting means for mounting the trowling blades to the rotatable shaft, and a shroud for shielding the blades, the improvement comprising:

the blades being mounted to the mounting means at a selected pitch;

an attachment member fixed to the exterior of the shroud; a manually operated throttle control including a manual grip and control element and having a short length pole, mounting means on the short pole for removably mounting the short pole the attachment member on the shroud to control the power unit and to permit guiding the shroud from adjacent the shroud; and a power unit control coupled to the control element to control the power unit; and an extendible elongated pole of substantial length, said extendible elongated pole having two ends and having means for mounting at one end matching the means for mounting on the short pole, and an opposite end of the extendible elongated pole having a coupling to receive the means for mounting on the short pole to permit the manual grip to control and guide the unit at an outer end of the extendible elongated pole.

* * * * *

UNITED STATES PATENT AND TRADEMARK OFFICE

CERTIFICATE OF CORRECTION

PATENT NO. : 5,372,452

DATED : December 13, 1994

INVENTOR(S) : James A. Hodgson

It is certified that error appears in the above-indentified patent and that said Letters Patent is hereby corrected as shown below:

Column 10, line 2, at the end of the line, cancel "," and insert --.--

Column 10, line 23, before "rotatable" insert --a--.

Signed and Sealed this

Tenth Day of October, 1995

*Attest:*

*Attesting Officer*

BRUCE LEHMAN

*Commissioner of Patents and Trademarks*